United States Patent [19]

De Gray

[11] Patent Number: 4,591,387

[45] Date of Patent: May 27, 1986

[54] ALOE VERA LEAF PROCESSOR

[76] Inventor: William G. De Gray, P.O. Box 36, Port Isabel, Tex. 78578

[21] Appl. No.: 577,961

[22] Filed: Feb. 7, 1984

[51] Int. Cl.[4] ..... C13C 1/00

[52] U.S. Cl. ..... 127/24; 83/865

[58] Field of Search ..... 99/537, 567, 538; 83/370, 404, 862, 865; 127/23, 24; 536/128; 131/313, 324

[56] References Cited

U.S. PATENT DOCUMENTS

| | | | |
|---|---|---|---|
| 2,241,081 | 5/1941 | Clark | 99/509 |
| 2,670,768 | 3/1954 | Yohn | 83/820 |
| 3,075,236 | 1/1963 | Mann et al. | 99/563 |
| 3,195,596 | 7/1965 | Peterson | 83/870 |
| 3,760,655 | 9/1973 | Buchmeier | 74/818 |
| 3,878,197 | 4/1975 | Maret | 424/195 |
| 3,907,101 | 9/1975 | Tomelleri | 99/636 |
| 4,395,942 | 8/1983 | Thompson | 99/538 |

*Primary Examiner*—Richard V. Fisher
*Assistant Examiner*—W. Gary Jones
*Attorney, Agent, or Firm*—Harvey B. Jacobson

[57] ABSTRACT

An elongated conveyor assembly is provided upon which an aloe vera leaf may be lengthwise disposed and lengthwise advanced from one end of the conveyor toward the other end thereof. First and second cutting stations are spaced along the conveyor assembly and are operative to remove the opposite ends of an aloe vera leaf and to trim the opposite side marginal edges of the leaf therefrom. In addition, third and fourth stations are disposed along the conveyor assembly between the second station and the discharge end of the conveyor assembly and the third station includes structure for peeling the lower rind panel from an aloe vera leaf whose ends and side marginal portions have been removed while the fourth station includes structure for removing the gel layer of the leaf disposed on the upper rind panel thereof and exposed by the removal of the lower rind panel of the leaf. All cutting, rind panel peeling and gel removal operations are carried out during continuous movement of the leaf along the conveyor assembly at a substantially constant rate and the second cutting station is operative to remove corresponding longitudinal marginal edge portions of the leaf independent of the width thereof.

12 Claims, 13 Drawing Figures

10
12
14
16
18
20
22
24
26
28
30
32
34
36
38
40
42
44
46
48
50
52
54
56
60
62
64
66
68
70
92
94
98
100
118
120
121
162
228

186
210

186
210

212
186
216
216
214

224
154
222
226
186

140
138
186
210
222
220

ALOE VERA LEAF PROCESSOR

BACKGROUND OF THE INVENTION

The interior gel of an aloe vera leaf has been found beneficial in the treatment of burns and other skin injuries as well as an ingredient in various cosmetics and pharmaceuticals. Heretofore, the use of aloe vera leaf gel for the treatment of such skin injuries was substantially limited to treatment in those areas in which the aloe vera plant grows because of the difficulty of commercially harvesting and processing the gel, only, of the aloe vera leaf for shipment to other locales in which the aloe vera plant does not grow.

Accordingly, a need exists for an apparatus by which aloe vera plant leaves may be processed so as to extract and obtain commercial quantities of the aloe vera leaf gel. Although the gel of the aloe vera leaf could be readily squeezed therefrom merely by cutting one end of the leaf and passing the leaf between opposing rolls, the aloe vera leaf gel is disposed in a layer thereof between the opposite side rind panels of the leaf and inwardly of layers of Aloin disposed immediately inwardly of the opposite side outer rind layers of the leaf. Accordingly, inasmuch as the presence of Aloin in the gel to be extracted from an aloe vera leaf is undesirable and the passing of an aloe vera leaf between opposing rolls would not only express the gel from the leaf but also the Aloin from the leaf along with the gel, a relative simple arrangement of opposing pressure rolls may not be used to effectively extract the middle gel layer from an aloe vera leaf.

Examples of various different forms of product processing mechanisms including some of the general structural and operational features of the instant invention are disclosed in U.S. Pat. Nos. 2,670,768, 3,075,236, 3,195,596, 3,760,655 and 3,907,101. However, these previously known processing apparatus are not well suited for extracting only the central gel layer from an aloe vera leaf.

BRIEF DESCRIPTION OF THE INVENTION

The leaf processor of the instant invention includes an elongated conveyor assembly for conveying aloe vera leaves from one end to the other and a plurality of stations spaced along the conveyor assembly which are operative to sequentially cut both ends from an aloe vera leaf, trim a predetermined marginal portion from each longitudinal side of the aloe vera leaf (thereby totally cutting the upper and lower outer rind panels of the leaf from each other) stripping one of the outer side rind panels of the aloe vera leaf as well as the adjacent Aloin layer from the remainder of the leaf and then scrapping or stripping the center gel layer of the leaf from the other outer side rind layer and attendant Aloin layer.

The conveyor is constructed whereby successive aloe vera leaves may be processed in a desired manner by a continuous process suitable to extract large commercial quantities of aloe vera leaf gel and also in a manner whereby variation in the length and width of the aloe vera leaves being processed may be compensated for.

The main object of this invention is to provide an apparatus by which the center gel layer of aloe vera leaves may be removed from the leaves in a manner with little contamination of Aloin which is present in an aloe vera leaf immediately inwardly of the opposite side rind layers of the leaf and on opposite sides of the center gel layer thereof.

Another object of this invention is to provide an apparatus which will be substantially fully automatic in operation and require only that aloe vera leaves to be processed be placed on the inlet end of the conveyor of the processor in position with the leaves extending lengthwise of the conveyor and in longitudinally spaced position relative to each other.

Still another object of this invention is to provide a leaf processor in accordance with the preceding objects and which will automatically compensate for variances in the thickness of aloe vera leaves being processed.

Still another important object of this invention is to provide an apparatus which will automatically compensate for differences in length and width of the aloe vera leaves being processed.

A further object of this invention is to provide an apparatus which will also function to strip the upper side outer rind layer of the aloe vera leaf from the remainder thereof after the upper outer side rind layer has been transformed into a substantially planar state.

A final object of this invention to be specifically enumerated herein is to provide an aloe vera leaf processor in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
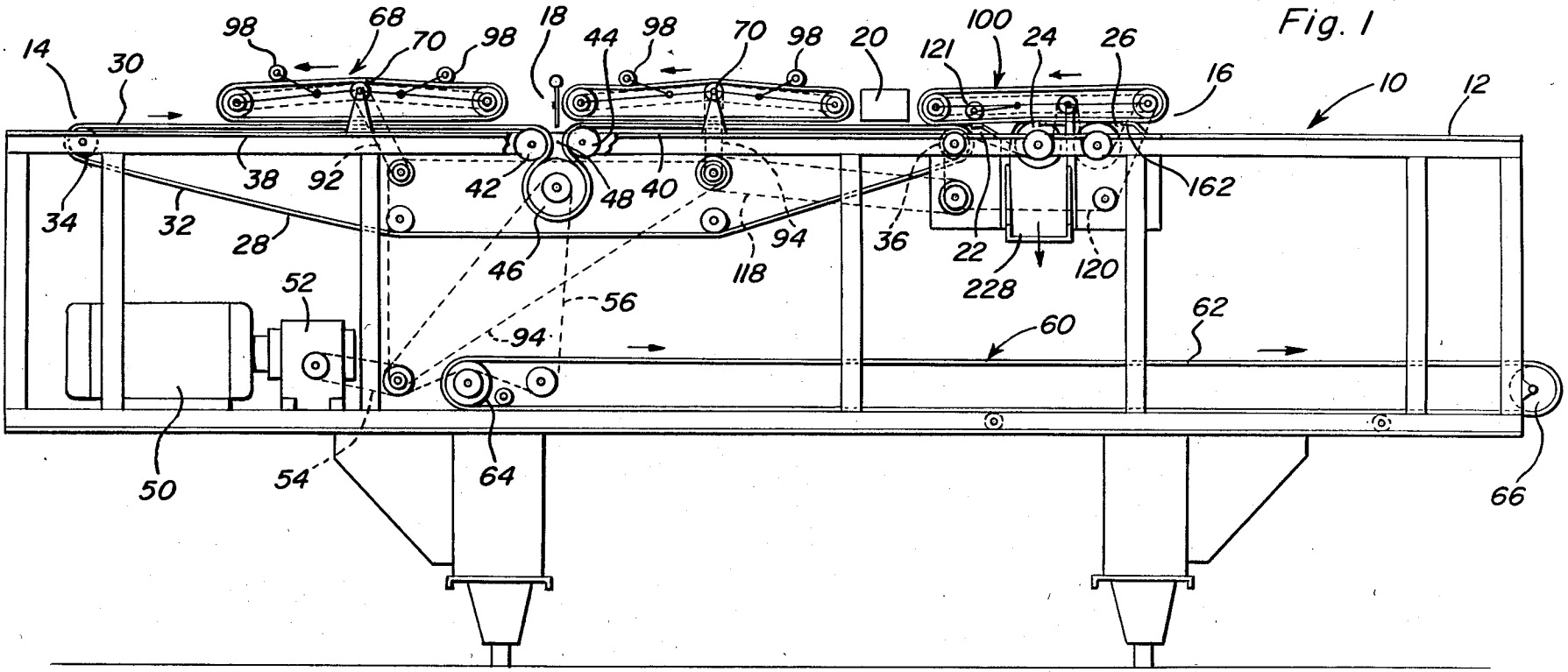
FIG. 1 is a side elevational view of the leaf processor of the instant invention.
Figure 4:
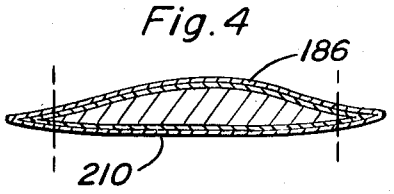
FIG. 4 is an enlarged transverse vertical sectional view of the aloe vera leaf illustrating the areas in which the opposite side marginal portions thereof are to be cut therefrom.
Figure 3:
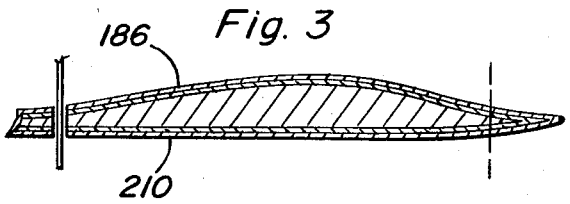
FIG. 3 is a longitudinal vertical sectional view of the aloe vera leaf illustrating the manner in which the opposite ends thereof are cut.

Referring now more specifically to the drawings, the numeral 10 generally designates the leaf processor of the instant invention. The processor 10 comprises an elongated conveyor including a main frame 12. The conveyor 10 includes an inlet end 14 and an outlet end 16 and incorporates longitudinally spaced first, second, third, fourth and fifth stations 18, 20, 22, 24 and 26 spaced therealong intermediate the inlet and outlet or discharge ends 14 and 16.

The conveyor 10 includes a main drive belt 28 including upper and lower reaches 30 and 32. The belt 28 is trained about rolls 34 and 36 extending transversely of the conveyor 10 and journalled from the frame 12. The upper reach 30 is disposed over and slidably engages longitudinally spaced inlet and outlet bed panels 38 and 40 supported from the frame 12 and a pair of longitudinally spaced transverse deflecting rolls 42 and 44 are journalled from the frame 12 between the adjacent ends of the panels 38 and 40. In addition, a third deflecting roll 46 is journalled from the frame 12 in vertical alignment with the space between the rolls 42 and 44 and the upper reach 30 of the belt 28 is deflected downwardly over the adjacent sides of the rolls 42 and 44 and about the underside of the roll 46 to define a transverse vertical zone 48 between those portions of the upper reach 30 which overlie the bed panels 38 and 40.

A drive motor 50 is supported from the frame 12 and is drivingly connected to the roll 46 through a gear reduction assembly 52 and a pair of endless flexible drive belts or chains 54 and 56.

A lower portion of the frame 12 supports a waste conveyor referred to in general by the reference numerals 60 and including an endless flexible belt 62 trained about drive and idle rolls 64 and 66 journalled from the frame 12. The endless flexible belt or chain 56 also drivingly connects the motor 50 to roll 64.

Figure 7:
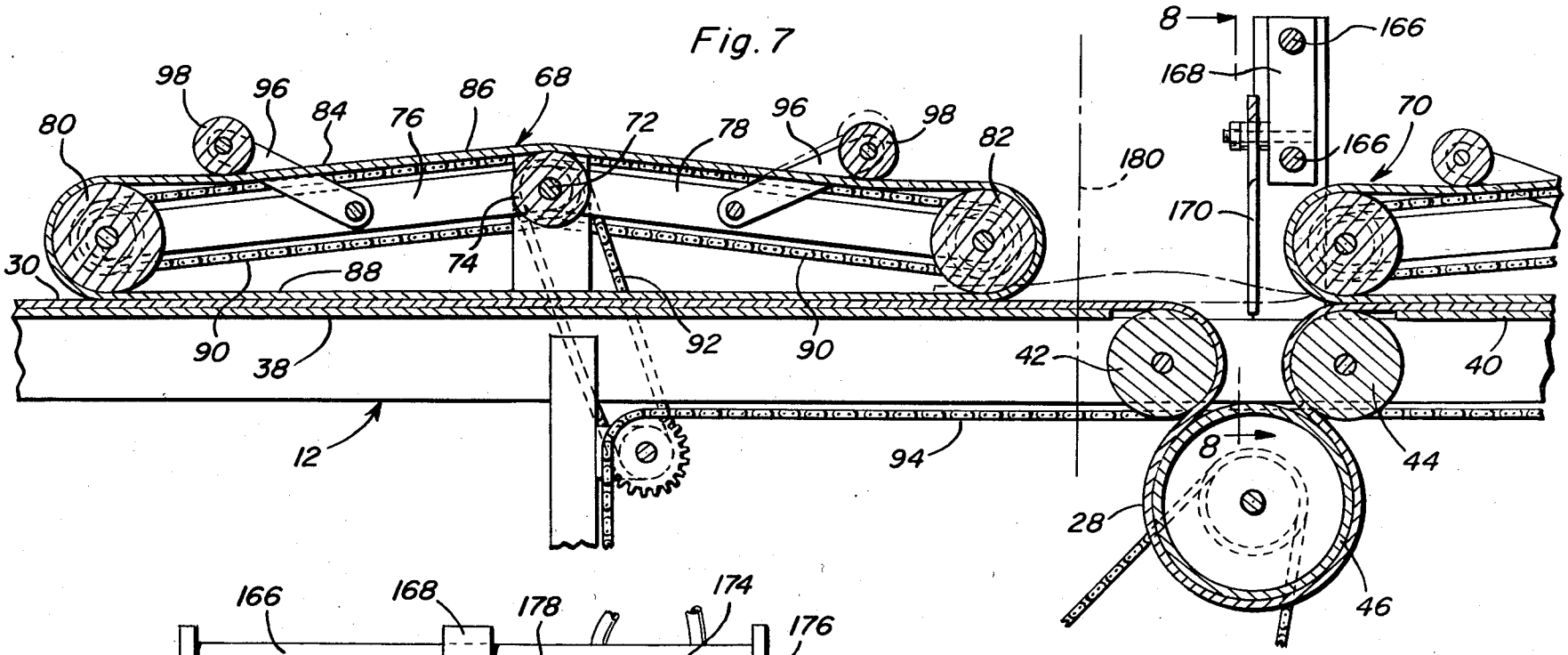
FIG. 7 is an enlarged fragmentary longitudinal vertical sectional view of the station on the conveyor assembly which performs the function of cutting the ends of the aloe vera leaf from the remainder thereof.
Figure 8:
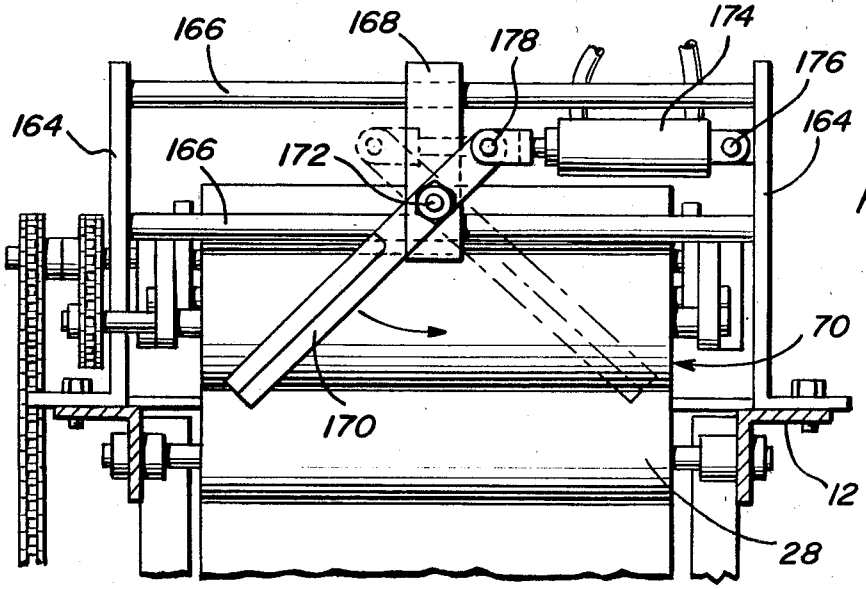
FIG. 8 is a transverse vertical sectional view taken substantially upon the plane indicated by the section line 8—8 of FIG. 7.

A pair of substantially identical upper drive conveyor assemblies, see FIG. 7, referred to in general by the reference numerals 68 overlie and coact the adjacent portions of the upper reach 30 disposed on opposite sides of the zone 48. Each of the conveyor assemblies 68 and 70 includes an upper support shaft 72 supported from the main frame 12 and having a roll 74 journalled therefrom. In addition, each shaft 72 has the adjacent ends of a pair of oppositely directed generally horizontal arm assemblies 76 and 78 oscillatably supported therefrom and the remote ends of the arm assemblies 76 and 78 journal rolls 80 and 82 therefrom about which an upper drive belt 84 is trained. Each upper drive belt 84 includes an upper reach 86 which passes over the corresponding roll 74 and a lower reach 88 which opposes and overlies the opposing portion of the upper reach 30. The rolls 80 and 82 are thus mounted for vertical gravity shifting relative to the bed plate 38 and the rolls 80 and 82 are each driven from the corresponding rolls 74 by an endless chain 90 and each roll 74 is driven by chains 92 and 94 drivingly connecting the motor 50 to the rolls 74. It will also be noted that each of the arm assemblies 76 oscillatably supports an auxiliary arm assembly 96 therefrom and that the free end of each auxiliary arm assembly 96 journals a transverse roller 98 therefrom supported by the corresponding arm assembly 96 for gravity vertical shifting relative to the frame 12. The rollers 98 are therefore downwardly biased into rolling engagement with the upper surfaces of the opposite ends of each upper reach 86. The belts 84 of the conveyor assemblies 68 and 70 are driven at substantially the same linear speed as the belt 28.

Figure 9:
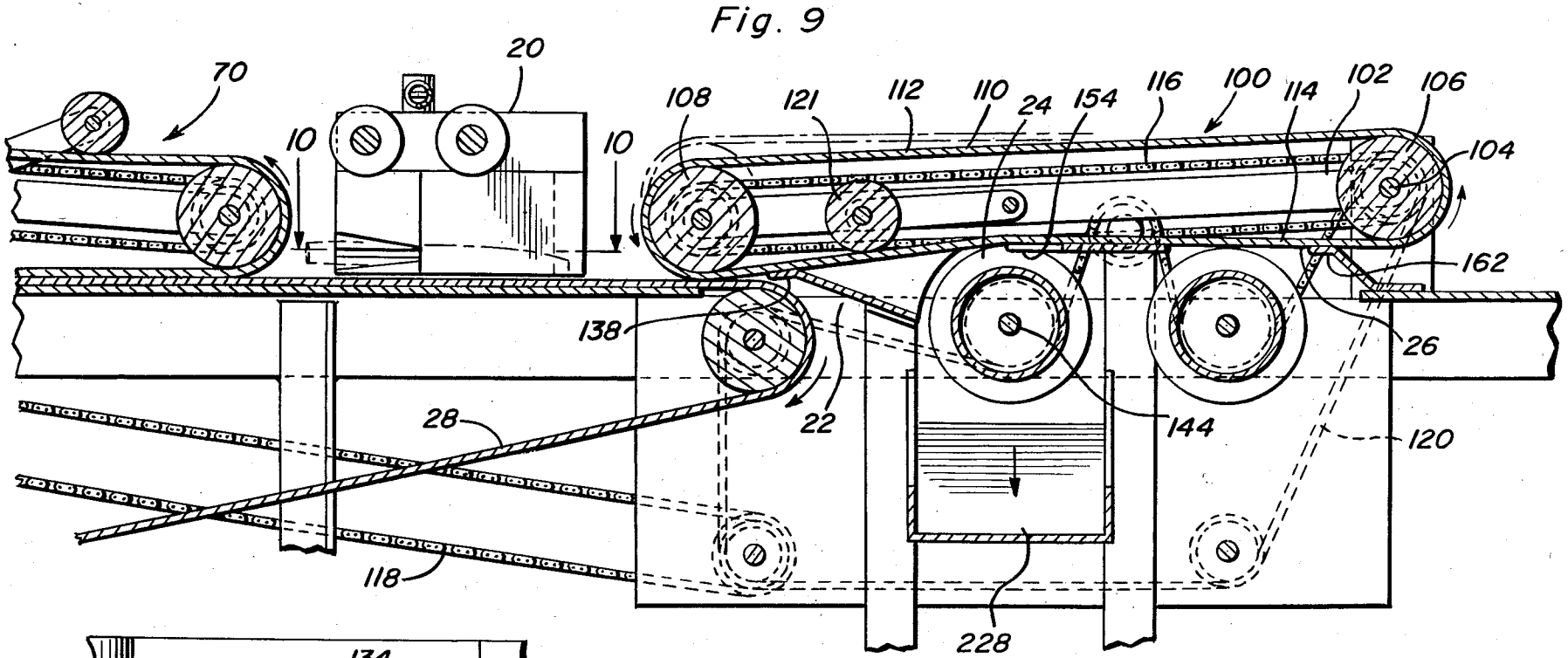
FIG. 9 is an enlarged fragmentary longitudinal vertical sectional view illustrating the stations spaced along the conveyor assembly in which the opposite side marginal edges are cut from the aloe vera leaf, the lower side rind panel is stripped or cut from the leaf and the layer of gel is removed from the underside of the upper outer rind panel of the leaf.

In addition, a third upper conveyor assembly, see FIG. 9, is referred to in general by the reference numeral 100 and includes an elongated frame 102 oscillatably supported at one end from a transverse shaft 104 supported from the frame 12 in elevated position relative thereto. The shaft 104 journals a roll 106 therefrom and the end of the frame 102 remote from the shaft 104 journals a second similar roll 108 therefrom. An endless flexible belt 110 is trained about the rolls 106 and 108 and includes upper and lower reaches 112 and 114. The rolls 106 and 108 are drivingly connected to each other by an endless chain 116 and the motor 50 is drivingly connected to the roll 106 by the chains 54 and 94 and additional chains 118 and 120. The belt 110 is driven at a linear speed which is also substantially identical to the linear speed of the belt 28 and a pressure roller 121, similar to the roliers 98, oscilliatably supported from the frame 102 and bears down on the upper surface of the lower reach 114.

With attention now invited more specifically to FIGS. 1, 7, 8, 9 and 12, it may be seen that the station 20 includes a pair of upright supports 122 supported from opposite sides of the frame 12 and that a pair of support and guide shafts 124 extend between the upper ends of the supports 122. A pair of substantially mirror image guide blocks 126 are guidingly supported from the guide shafts 124 for movement toward and away from each other. The shafts 124 include center stops 128 between the adjacent sides of the blocks 126 and an expansion spring 130 is connected between the blocks 126 and yieldingly biases the latter toward engagement with the center stops 128. The guide blocks 126 include forwardly opening and rearwardly tapering guide grooves 132 formed in their lower portions opposing each other and oppositely outwardly opening lateral windows 134 in the inner ends of which outwardly curving upstanding cutting blades 136 are disposed.

Figure 13:
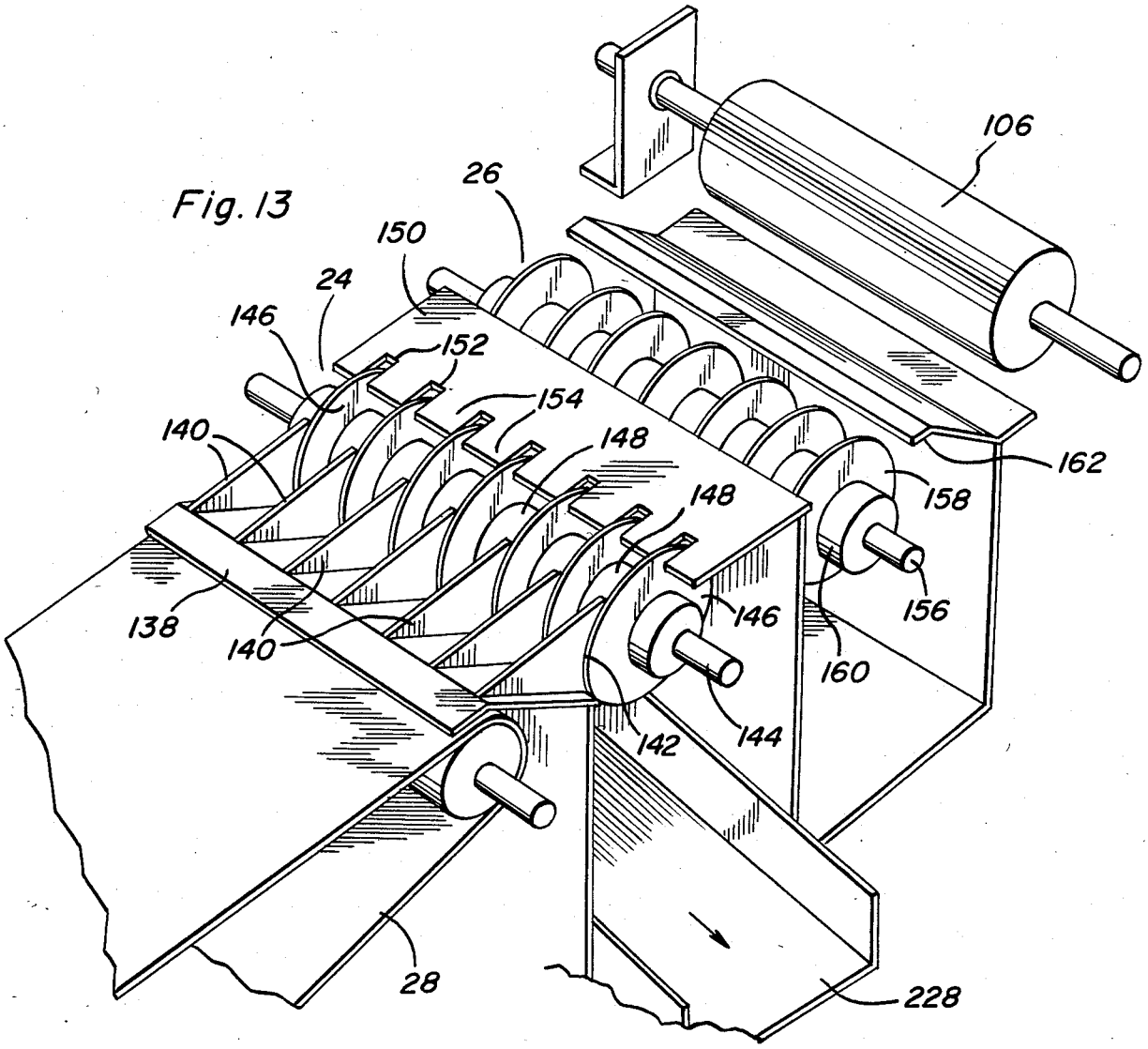
FIG. 13 is a fragmentary perspective view of the right-hand portion of the area of the conveyor illustrated in FIG. 9.

Station 22 includes a stationary transverse stripper blade 138, see FIGS. 9 and 13, and a plurality of laterally spaced and longitudinally extending slightly rearwardly and upwardly inclined grooving plates 140 including rearwardly opening arcuate rear edges 142. In addition, the station 24 includes a shaft 144 journalled from the frame 12 and driven by the chain 120 and the shaft 144 includes circular blades 146 spaced therealong aligned with the plates 140, cylindrical spacers 148 being mounted on the shaft 144 between adjacent blades 146.

Further, the station 24 also includes a transverse horizontal shear plate 150 supported from the frame 12 and including longitudinally spaced forwardly opening slots 152 defining forwardly projecting tongues 154 between adjacent slots 152.

Station 26 includes a shaft 156 corresponding to the shaft 144 and including blades 158 and spacers 160 corresponding to the blades 146 and spacers 148. In addition, the station 26 includes a transverse horizontal stripper blade 162.

With reference again to station 18, station 18 includes a pair of opposite side upright supports 164 supported from opposite sides of the frame 12. A pair of upper and lower support shafts 166 extends between the supports 164 and mount a vertical bracket 168 from their midportions, see FIG. 8. A double-edged elongated upstanding cutting blade 170 is oscillatably supported from the bracket 168 adjaoent its upper end portion by a pivot fastener 172 and a double acting air cylinder 174 has one end pivotally anchored to the right-hand support 164 as at 176 and the other extendible end thereof pivotally anchored to the upper end of the blade 170 as at 178.

Figure 11:
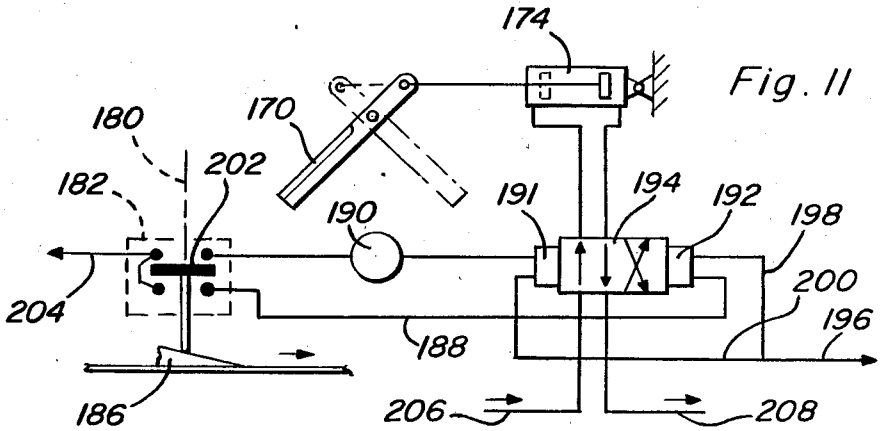
FIG. 11 is a schematic view illustrating the fluid pressure system and leaf sensing control therefor operative to cut the opposite ends from a leaf being processed.
Figure 10:
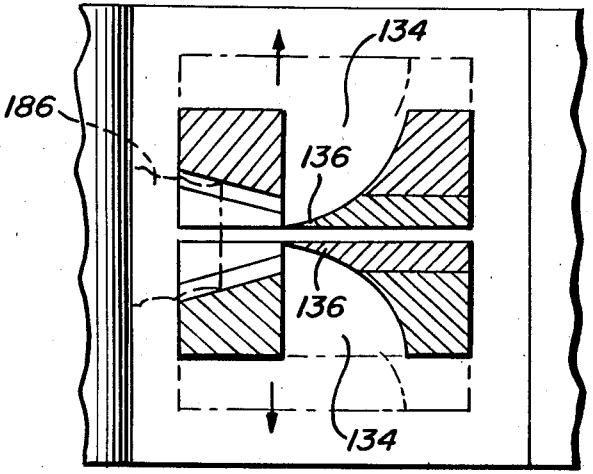
FIG. 10 is a fragmentary horizontal sectional view taken substantially upon the plane indicated by the section line 10—10 of FIG. 9.
Figure 12:
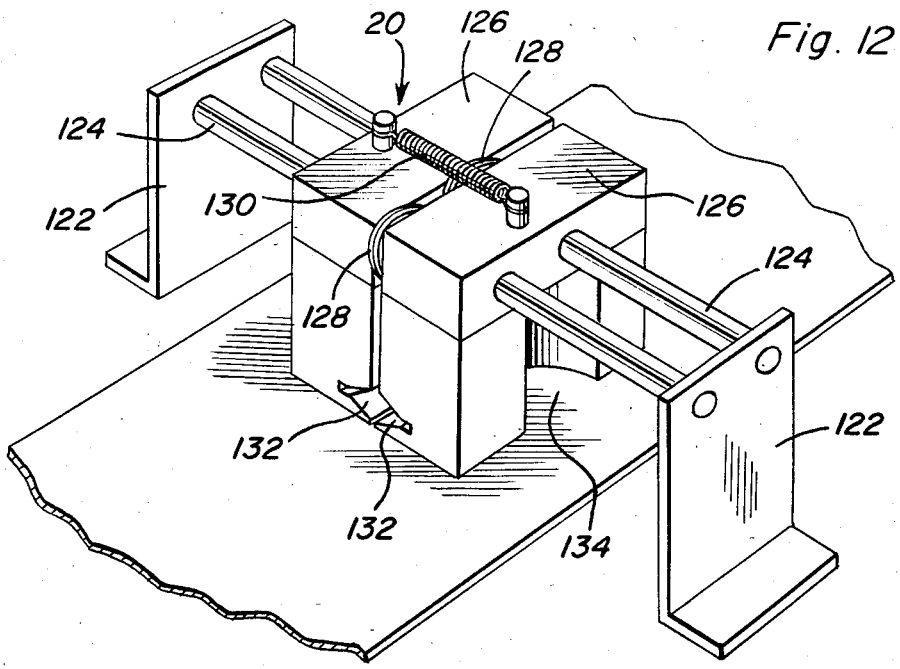
FIG. 12 is a fragmentary perspective view illustrating the station of the conveyor assembly by which the longitudinal marginal edge portions of a leaf being processed or removed.

With reference now more specifically to FIG. 11 of the drawings, the numeral 180 designates a signal plane (see also FIG. 7) and a signal generator 182 is disposed in the signal plane 180. The signal generator 182 may be in the form of a photoelectric cell, fluidic or pneumatic airstream, micro or whisker switch, or any other device capable of detecting the absence or presence of an object such as an aloe vera leaf 186. The signal generator 182 is electrically connected in a loop circuit 188 in which a time delay relay 190 is also serially connected and the loop circuit is electrically connected to the solenoids 191 and 192 of a 4-way solenoid air valve 194, the solenoids being electrically connected to a neutral ground 196 by conductors 198 and 200. The loop circuit 188 has a switch actuator 202 of a double acting switch serially connected therein and the double acting switch is electrically connected to a suitable source of electrical potential by a conductor 204. Further, air is supplied to the air valve 194 by an air supply line 206 and discharged from the air valve 194 through a discharge line 208.

Figure 2:
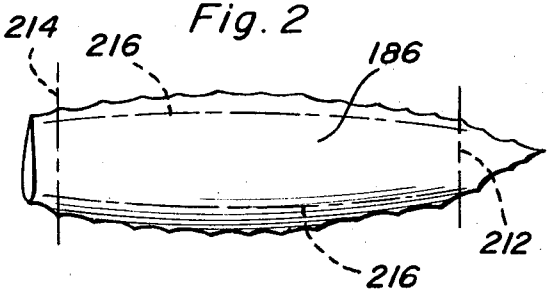
FIG. 2 is a top plan view of a typical aloe vera leaf with the end and opposite side cuts to be made thereon indicated by phantom lines.

In operation, an aloe vera leaf 186 is placed upon the belt 28 immediately before the conveyor assembly 68 with the substantially flat underside rind panel or layer 210 of the leaf 186 lowermost. The leaf 186 is then conveyed along the belt 32 beneath the conveyor assembly 68 toward the signal plane 180. As the leaf 186 reaches the signal plane 180, the signal generator 182 senses the presence of the leaf 186 and the switch 102 electrically connects the source 204 with the time delay relay 190 and the solenoid 191 is thereafter actuated and air will be supplied to the cylinder 174 in order to retract the piston rod thereof and cause the blade 170 to swing from the phantom-line position of FIG. 11 to the solid-line position of FIG. 11 and to cut off the leading end of the leaf 186 along the cut line 212 see FIG. Z. As the leaf I86 continues along the conveyor belt 28, the trailing end of the leaf 186 will pass through the signal plane 180 and the "leaf presence" signal is terminated and the "no-presence" is initated by the signal generator 182. At this point, the switch electrically connects the source 204 with the solenoid 192 and the valve 94 is operated to cause air to be delivered to the cylinder 174 in a manner to extend the piston thereof. Accordingly, the blade 170 is swung from the solid-line position of FIG. 11 to the phantom-line position of FIG. 11 and the rear end of the leaf 186 is cut along the cut plane 214, see FIG. 2.

The leaf 186 thereafter continues its movement along the conveyor belt 28 toward the station 20. At the station 20, the leading end of the leaf 186 has its opposite side marginal portions received in the slots or notches 132 and the blades 136 make their initial cuts along opposite longitudinal sides of the leaf 186. As the leaf 186 continues to move along the belt 28, the blocks 126 are spread apart by the leaf 186 thus also moving the blades 136 apart. Accordingly, the blades 136 contour cut the opposite side longitudinal edge portions from the leaf 186 along the cut lines 216, see FIG. 2. The cut lines 216 substantially parallel the outer opposite side longitudinal edges of the leaf 186. The cut edge portions of the leaf are discharged through the windows 134. Alternately, the blocks 126 may be replaced by yieldingly mounted and journaled grooved or formed rollers serving the same function as the grooved blocks 126.

Figure 6:
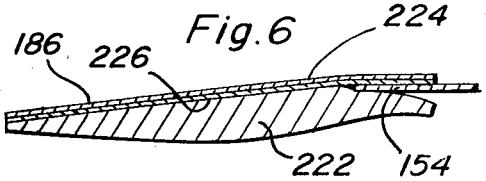
FIG. 6 is a longitudinal vertical sectional view similar to FIG. 5 but illustrating the manner in which the gel layer is stripped from the upper rind panel and adjacent Aloin layer.
Figure 5:
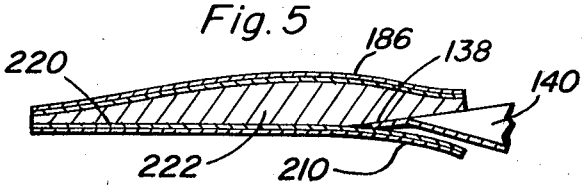
FIG. 5 is a longitudinal vertical sectional view of the aloe vera leaf after having the opposite side and end marginal portions thereof cut-away and with the lower side rind panel and adjacent Aloin layer being stripped therefrom.

After the opposite side marginal portions of the leaf 186 have been cut therefrom at station 20, the leaf 186 is further conveyed to station 22 at which point the blade 138 peels the lower rind layer 210 and lower Aloin layer 220 from the leaf 186. Inasmuch as the lower rind layer is substantially planar, the lower rind layer 210 and lower Aloin layer 220 are cleanly removed by the planar blade 138. Thereafter, the leaf 186 moves toward the station 24 over the plates 140 which serve to groove the gel 222 exposed by removal of the layers 210 and 220. In addition, the plates 140 transform compound curvature upper rind layer 224 of the leaf 186 into a planar state and as the leaf 186 moves from the plates 140 it contacts the discs 146 which are aligned with the plates 140 and thereafter moves toward engagement with the tongues 154. The tongues 154 then strip the gel 222 from the upper rind layer 224 and upper Aloin layer 226 in the manner illustrated in FIG. 6. The gel 222 which has been removed from the layers 224 and 226 falls downwardly into the inclined lateral trough 228 disposed beneath the station 24. Thereafter, the remaining upper rind layer 224 and Aloin layer 226 move to station 26 in which they are zemoved by engagement of the blade 162 along the underside of the belt 110.

As the leaf 186 moves through station 24, the pressure roller 121 bears down on the lower reach 114 and thus the leaf 186 and functions to control the depth of the grooving of the gel 222 by the plates 140 and discs 146. Also, the downward force (gravity) of the roller 121 on the lower reach 14 further functions to aid in the stripping of the gel 222 from the upper rind layer 224.

Thus, it may be seen that the gel 222 may be readily removed from within the leaf 186 substantially independent of contamination of the gel 222 by either of the Aloin layers 220 and 226.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An aloe vera leaf processor for processing elongated aloe vera leaves including marginally joined top and bottom rind panels each including an adjacent thin aloin layer and a gel layer disposed between the aloin layers of said panels, said processor including an elongated conveyor assembly for lengthwise receiving an elongaged leaf thereon at one end and including means for supporting and lengthwise advancing said leaf along said conveyor assembly toward the other end thereof, said conveyor assembly including first, second, third and fourth locations thereon spaced along the conveyor assembly from said one end toward said other end, said first location including first cutting means operative to transversely cut the leading and trailing ends of said leaf therefrom as said leaf is conveyed through said first location, second cutting means disposed at said second location operative to contour cut the opposite side marginal edges of said leaf from the remainder thereof, third cutting means disposed at said third location operative to cut one of the top and bottom rind panels as well as the attendant aloin layer from said leaf and gel removal means disposed at said fourth location operative to remove to gel layer, exposed by the removal of said one rind panel, from the other rind panel attendant aloin layer of said leaf.

2. The leaf processor of claim 1 including rind panel flattening means intermediate said third and fourth locations operative to render said other rind panel and attendent aloin layer at least substantially planar immediately prior to removal of said gel from said other rind panel and the attendant aloin layer by said gel removal means.

3. The leaf processor of claim 2 wherein said rind panel flattening means includes means operative to form transversely spaced and elongated grooves in said gel.

4. The leaf processor of claim 3 wherein said gel removal means includes means for removing strips of said gel from between said grooves.

5. The leaf processor claim 1 wherein said means for supporting and advancing said leaf along said conveyor assembly includes a main conveyor belt having a generally horizontal reach thereof extending lengthwise along said conveyor assembly and moving from said one end toward said other end, generally horizontal belt backing surface means underlying said reach for support of the latter from beneath and secondary belt means including a lower reach overlying said horizontal reach for frictional engagement with said leaf from above, means driving said reaches at substantially the same linear speed, said secondary belt including a generally horizontal upper reach and having a longitudinal midportion thereof upwardly deflected by an elevated support roller journalled from said conveyor assembly and over which said upper reach passes, a pair of end rolls spaced in opposite directions along said conveyor assembly from said elevated support roller and journalled from said conveyor assembly for vertical gravity biased shifting relative thereto and about which the remote ends of said secondary belt are trained and a pair of belt tensioning rolls journalled from said conveyor assembly for vertical gravity biased shifting relative thereto and rollingly engaged with and downwardly deflecting those portions of the upper reach of said secondary belt extending between said support roll and said end rolls.

6. The leaf processor of claim 1 wherein said means for supporting and advancing said leaf along said conveyor assembly includes a main conveyor belt having a generally horizontal reach thereof extending lengthwise along said conveyor assembly and moving from said one end toward said other end, generally horizontal belt backing surface means underlying said reach for support of the latter from beneath and secondary belt means including a lower reach overlying said horizontal reach for frictional engagement with said leaf from above, means driving said reaches at substantially the same speed, said main conveyor belt horizontal reach including a midportion thereof supported from and disposed over a pair of deflecting rolls journalled from said conveyor assembly and closely spaced longitudinally therealong, a third deflecting roll journalled from said conveyor assembly below said pair of deflecting rolls and vertically aligned with the spacing therebetween, said horizontal reach between said pair of deflecting rolls being trained beneath and about said third deflecting roll, said first cutting means including shifting knife means operable transversely of said conveyor assembly in the spacing between said pair of deflecting rolls.

7. The leaf processor of claim 1 wherein said second cutting means includes a pair of opposing bodies supported closely above said conveyor assembly and mounted for movement laterally of said conveyor assembly toward and away from each other, the opposing sides of said bodies including opposing horizontally outwardly opening notches formed therein for wedgingly receiving the opposite side longitudinal marginal portions of said leaf therein, said bodies including upstanding cutting edge means supported therefrom in downstream position from said notches and operative to contour trim the opposite longitudinal marginal edge portions of said leaf from the remainder thereof, means connected between said bodies lightly yieldingly biasing said bodies toward each other.

8. An aloe vera leaf processor for processing elongated aloe vera leaves including marginally joined top and bottom rind panels each including an attendant immediately adjacent aloin layer and a gel layer disposed between said panels, said processor including an elongated conveyor assembly for lengthwise receiving an elongated leaf thereon at one end and including means for supporting and lengthwise advancing said leaf along said conveyor assembly toward the other end thereof, said conveyor assembly including first, second, third and fourth locations thereon spaced therealong from said one end toward said other end, first and second cutting means disposed at said first and second locations, one of said cutting means being operative to cut the leading and trailing ends of said leaf therefrom and the second cutting means being operative to contour cut the opposite longitudinal marginal edges from said leaf, third cutting means disposed at said third location operative to cut one of the top and bottom rind panels and the attendant adjacent aloin layer from said leaf, and gel removal means disposed at said fourth location operative to remove the gel layer, exposed by the removal of said one rind panel, from the other rind panel and attendant aloin layer of said leaf.

9. The leaf processor of claim 8 including rind panel flattening means intermediate said third and fourth locations operative to render said other rind panel at least substantially planar immediately prior to the removal of the gel layer from said other rind panel by said gel removal means.

10. The leaf processor of claim 9 wherein said rind panel flattening means includes means operative to form transversely spaced and elongated grooves in said gel.

11. The leaf processor of claim 10 wherein said gel removal means includes means for removing strips of said gel from between said grooves.

12. An aloe vera leaf processor for processing elongated aloe vera leaves including marginally joined top and bottom rind panels each including an attendant immediately adjacent aloin layer and a gel layer disposed between said aloin layers and wherein one of said panels is generally flat while the other of said panels is compound convexly curved, said processor including an elongated conveyor assembly for lengthwise receiving an elongated leaf thereon at one end and including means for supporting and lengthwise advancing said leaf along said conveyor assembly toward the other end thereof with said compound convexly curved rind panel disposed uppermost, said conveyor assembly including first, second, third and fourth locations thereon spaced therealong from said one end toward said other end, first and second cutting means disposed at said first and second locations, one of said cutting means being operative to cut the leading and trailing ends of said leaf therefrom and the second cutting means being operative to contour cut the opposite longitudinal marginal edges from said leaf, third cutting means disposed at said third location operative to cut the lowermost rind panel and the attendant adjacent aloin layer from said leaf and gel removal means disposed at said fourth location operative to remove the gel layer exposed by the removal of the lowermost rind panel from the upper rind panel and attendant aloin layer of said leaf, said conveyor including means intermediate said third and fourth locations operative to render said uppermost rind panel at least substantially planar immediately prior to the removal of the gel layer from the uppermost rind panel by said gel removal means.

* * * * *